US010041144B2

(12) United States Patent
Takahashi et al.

(10) Patent No.: US 10,041,144 B2
(45) Date of Patent: Aug. 7, 2018

(54) METHOD FOR SMELTING NICKEL OXIDE ORE

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 15/328,634

(22) PCT Filed: Jun. 30, 2015

(86) PCT No.: PCT/JP2015/068855
§ 371 (c)(1),
(2) Date: Jan. 24, 2017

(87) PCT Pub. No.: WO2016/017347
PCT Pub. Date: Feb. 4, 2016

(65) Prior Publication Data

US 2017/0204496 A1 Jul. 20, 2017

(30) Foreign Application Priority Data

Aug. 1, 2014 (JP) ..... 2014-157576

(51) Int. Cl.
*C22B 23/00* (2006.01)
*C22B 1/00* (2006.01)
(Continued)

(52) U.S. Cl.
CPC ..... *C22B 23/021* (2013.01); *C22B 1/00* (2013.01); *C22B 1/16* (2013.01); *C22B 1/245* (2013.01);
(Continued)

(58) Field of Classification Search
CPC ..... C22B 23/021; C22B 1/2413; C22B 1/16; C22B 1/2406; C22B 1/00; C22B 23/005
See application file for complete search history.

(56) References Cited

U.S. PATENT DOCUMENTS 4,195,986 A 4/1980 Schulz et al.
4,659,374 A * 4/1987 Alanko ..... C22B 1/244 420/478
(Continued)

FOREIGN PATENT DOCUMENTS

CA 1332286 C 10/1994
CN 101020958 A 8/2007
(Continued)

OTHER PUBLICATIONS

CN 101392329 A machine translation (Year: 2009).*
(Continued)

*Primary Examiner* — George Wyszomierski
*Assistant Examiner* — Tima M McGuthry-Banks
(74) *Attorney, Agent, or Firm* — Locke Lord LLP

(57) ABSTRACT

Provided is a method for smelting nickel oxide ore by which the occurrence of cracking due to heat shock can be suppressed when nickel oxide ore is pelletized and charged into a smelting step (reduction step). A method for smelting nickel oxide ore according to the present invention uses pellets of nickel oxide ore, the method being characterized by comprising a pellet production step S1 for producing pellets from nickel oxide ore, and a reduction step S2 for heating the resulting pellets at a predetermined reduction temperature in a reduction furnace, the reduction step S2 comprising preheating the pellets obtained in the pellet production step S1 to a temperature of 350 to 600° C. in the reduction furnace and thereafter charging the pellets into the
(Continued)

reduction furnace and raising the temperature of the reduction furnace to the reduction temperature.

1 Claim, 3 Drawing Sheets

(51) Int. Cl.

| | |
|---|---|
| ***C22B 1/24*** | (2006.01) |
| ***C22B 1/16*** | (2006.01) |
| ***C22B 23/02*** | (2006.01) |
| ***C22B 1/245*** | (2006.01) |
| ***C22C 33/04*** | (2006.01) |
| ***C22B 5/10*** | (2006.01) |

(52) U.S. Cl.
CPC ..... *C22B 1/2406* (2013.01); *C22B 1/2413* (2013.01); *C22B 5/10* (2013.01); *C22B 23/005* (2013.01); *C22B 23/02* (2013.01); *C22C 33/04* (2013.01)

(56) References Cited

U.S. PATENT DOCUMENTS

| | | | | |
|---|---|---|---|---|
| 5,178,666 | A | 1/1993 | Diaz et al. | |
| 2005/0211020 | A1 | 9/2005 | Sugitatsu et al. | |
| 2009/0324440 | A1* | 12/2009 | Marsh | C21B 13/00 420/8 |
| 2011/0308352 | A1 | 12/2011 | Makela et al. | |

FOREIGN PATENT DOCUMENTS

| | | | | |
|---|---|---|---|---|
| CN | 101392329 | A | | 3/2009 |
| CN | 101403043 | A | | 4/2009 |
| CN | 101538645 | A | * | 9/2009 |
| CN | 201555450 | U | | 8/2010 |
| CN | 102010986 | A | | 4/2011 |
| CN | 102453824 | A | | 5/2012 |
| CN | 102758085 | A | | 10/2012 |
| CN | 102758085 | B | * | 10/2012 |
| CN | 202912992 | U | | 5/2013 |
| CN | 103233114 | A | | 8/2013 |
| CN | 102758085 | B | | 11/2013 |
| CN | 103436698 | A | | 12/2013 |
| JP | 54-153722 | A | | 12/1979 |
| JP | 02-111840 | A | | 4/1990 |
| JP | 2004-156140 | A | | 6/2004 |
| JP | 2012-517523 | A | | 8/2012 |

OTHER PUBLICATIONS

CN 103436698 A machine translation (Year: 2013).*
CN 101538645 A machine translation (Year: 2009).*
CN 102367512 A machine translation (Year: 2012).*
CN-103233114 written translation for the references in the drawing. (Year: 2013).*
CN 102758085-B machine translation (Year: 2012).*
CN 10323314, full human translation. (Year: 2013).*
International Search Report dated Aug. 11, 2015, issued for PCT/JP2015/068855.
Office Action dated Mar. 30, 2017, issued for Canadian Patent Application No. 2956259.
Extended European Search Report dated Jul. 24, 2017, issued to EP Patent Application No. 15828220.2.
Office Action dated Aug. 29, 2017, issued to CN Patent Application No. 201580039569.1.
Office Action dated Feb. 16, 2017 issued for corresponding Canadian Patent Application No. 2,954,028.
Extended European Search Report dated Jul. 19, 2017, issued to EP Patent Application No. 15821709.1.
Office Action dated Aug. 4, 2017, issued to CN Patent Application No. 201580034483.X.
Office Action issued to U.S. Appl. No. 15/325,515, dated Nov. 9, 2017.

* cited by examiner

METHOD FOR SMELTING NICKEL OXIDE ORE

CROSS REFERENCE TO RELATED APPLICATIONS

This application is related to co-pending applications: "METHOD FOR SMELTING NICKEL OXIDE ORE" filed even date herewith in the names of Junichi TAKAHASHI, Taku INOUE and Shuuji OKADA as a national phase entry of PCT/JP2015/069849; and "METHOD FOR PRODUCING PELLETS AND METHOD FOR PRODUCING IRON-NICKEL ALLOY" filed even date herewith in the names of Junichi TAKAHASHI, Taku INOUE and Shuuji OKADA as a national phase entry of PCT/JP2015/068856; which applications are assigned to the assignee of the present application and all three incorporated by reference herein.

TECHNICAL FIELD

The present invention relates to a method for smelting nickel oxide ore using pellets of nickel oxide ore.

BACKGROUND ART

As methods for smelting nickel oxide ore called limonite or saprolite, a method of dry smelting that produces nickel matt using a flash smelting furnace, a method of dry smelting that produces ferronickel using a rotary kiln or moving hearth furnace, a method of wet smelting that produces a mix sulfide using an autoclave, etc. have been known.

Upon charging the nickel oxide ore to the smelting step, pre-processing is performed for pelletizing, making into a slurry, etc. the raw material ore. More specifically, upon pelletizing the nickel oxide ore, i.e. producing pellets, it is common to mix components other than this nickel oxide ore, e.g., binder and reducing agent, then further perform moisture adjustment, etc., followed by charging into agglomerate producing equipment to make a lump on the order of 10 to 30 mm, for example (indicated as pellet, briquette, etc.; hereinafter referred to simply as "pellet").

It is important for this pellet to maintain the shape thereof even if the smelting operations such as loading into a smelting furnace and reducing and heating is begun in order to achieve the roles such as preserving breathability and prevention of uneven distribution of raw material components, for example.

For example, Patent Document 1 discloses technology of adjusting excess carbon content of the mixture in a mixing step to make a mixture by mixing raw materials including nickel oxide and iron oxide with carbonaceous reducing agent, as a pre-treatment method upon producing ferronickel using a moving hearth furnace.

However, when pelletizing this mixture in order to load into the smelting furnace, and heating to the reduction temperature, so-called heat-shock may occur whereby the pellets break, and there are problems of inhibiting progression of the smelting reaction, or the product becoming smaller and recovery becoming difficult. Therefore, commercial operation becomes difficult if not curbing at least the proportion of pellets broken by heat shock to on the order of 10%.

Patent Document 1: Japanese Unexamined Patent Application, Publication No. 2004-156140

DISCLOSURE OF THE INVENTION

Problems to be Solved by the Invention

The present invention has been proposed taking account of such a situation, and has an object of providing a method for smelting nickel oxide ore using pellets of nickel oxide ore, and can suppress the occurrence of heat shock-induced cracks in pellets upon pelletizing nickel oxide ore and charging into a smelting step (reduction step).

Means for Solving the Problems

The present inventors have thoroughly investigated in order to solve the aforementioned problem. As a result thereof, it was found that it is possible to suppress the occurrence of heat shock-induced cracking when reducing and heating at high temperature, by charging pellets containing nickel oxide ore used in a method for smelting nickel oxide ore into a reducing furnace for heating and reducing, following by conducting preheat treatment on these pellets at a predetermined temperature prior to raising the reducing furnace to a reduction temperature, thereby arriving at completion of the present invention. In other words, the present invention provides the following matters.

A first aspect of the present invention is a method for method for smelting nickel oxide ore using pellets of nickel oxide ore, the method including: a pellet production step of producing pellets from the nickel oxide ore; and a reduction step of heating the pellets obtained at a predetermined reduction temperature with a reducing furnace, in which the pellets obtained in the pellet production step are charged into the reducing furnace, and the pellets are preheat treated at a temperature of 350° C. to 600° C. with the reducing furnace prior to raising the reducing furnace to the reduction temperature in the reduction step.

According to a second aspect of the present invention, in the method for smelting nickel oxide ore as described in the first aspect, the pellets are preheat treated at a temperature of 400° C. to 550° C. with the reducing furnace.

According to a third aspect of the present invention, in the method for smelting nickel oxide ore as described in the first or second aspect, the pellets are preliminarily heated prior to charging the pellets into the reducing furnace.

According to a fourth aspect of the present invention, in the method for smelting nickel oxide ore as described in the third aspect, the pellets are preliminarily heated by holding at a temperature of 100° C. to 170° C. for 2 hours or more.

Effects of the Invention

According to the present invention, even in a case of performing reducing heat treatment at a reduction temperature that is a high temperature in the smelting using pellets of nickel oxide ore, it is possible to maintain the shape thereof by suppressing the occurrence of heat shock-induced cracking of pellets, and thus the industrial value thereof is very great.

PREFERRED MODE FOR CARRYING OUT THE INVENTION

Hereinafter, a specific embodiment of the present invention (hereinafter referred to as "present embodiment") will be explained in detail while referencing the drawings. It should be noted that the present invention is not to be limited to the following embodiment, and that various modifications within a scope not departing from the gist of the present invention are possible.

1. Method for Smelting Nickel Oxide Ore

First, a method for smelting nickel oxide ore, which is raw material ore, will be explained. Hereinafter, it will be explained giving as an example a method for smelting that produces ferronickel by pelletizing nickel oxide ore, which is the raw material ore, then generates metal (iron-nickel alloy (hereinafter iron-nickel alloy is referred to as "ferronickel")) and slag by reduction treating these pellets, and then separates this metal and slag.

Figure 1:
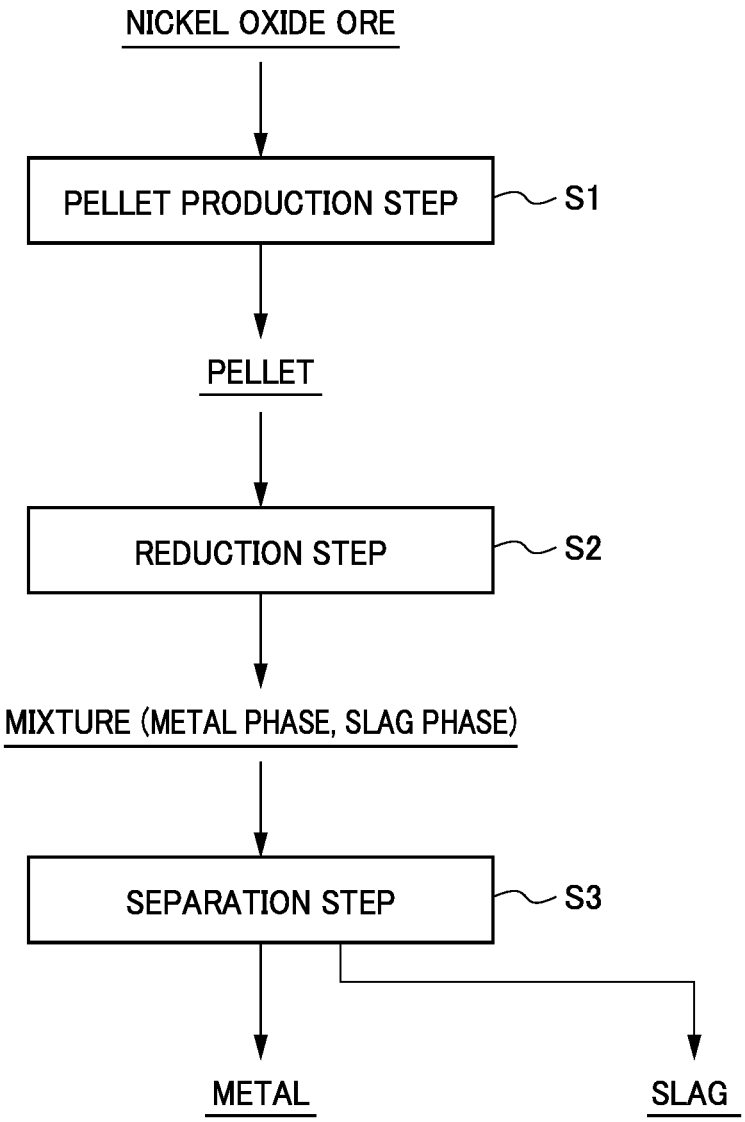
FIG. 1 is a process chart showing the flow of a method for smelting nickel oxide ore.

The method for smelting nickel oxide ore according to the present embodiment is a method for smelting using pellets of nickel oxide ore, by charging these pellets into a smelting furnace (reducing furnace), then reducing and heating. More specifically, as shown in the process chart of FIG. 1, this method for smelting nickel oxide ore includes a pellet production step S1 of producing pellets from nickel oxide ore, a reduction step S2 of reducing and heating the obtained pellets in a reducing furnace at a predetermined reduction temperature, and a recovery step S3 of recovering metal by separating the slag and metal generated in the reduction step S2.

1.1. Pellet Production Step

Figure 2:
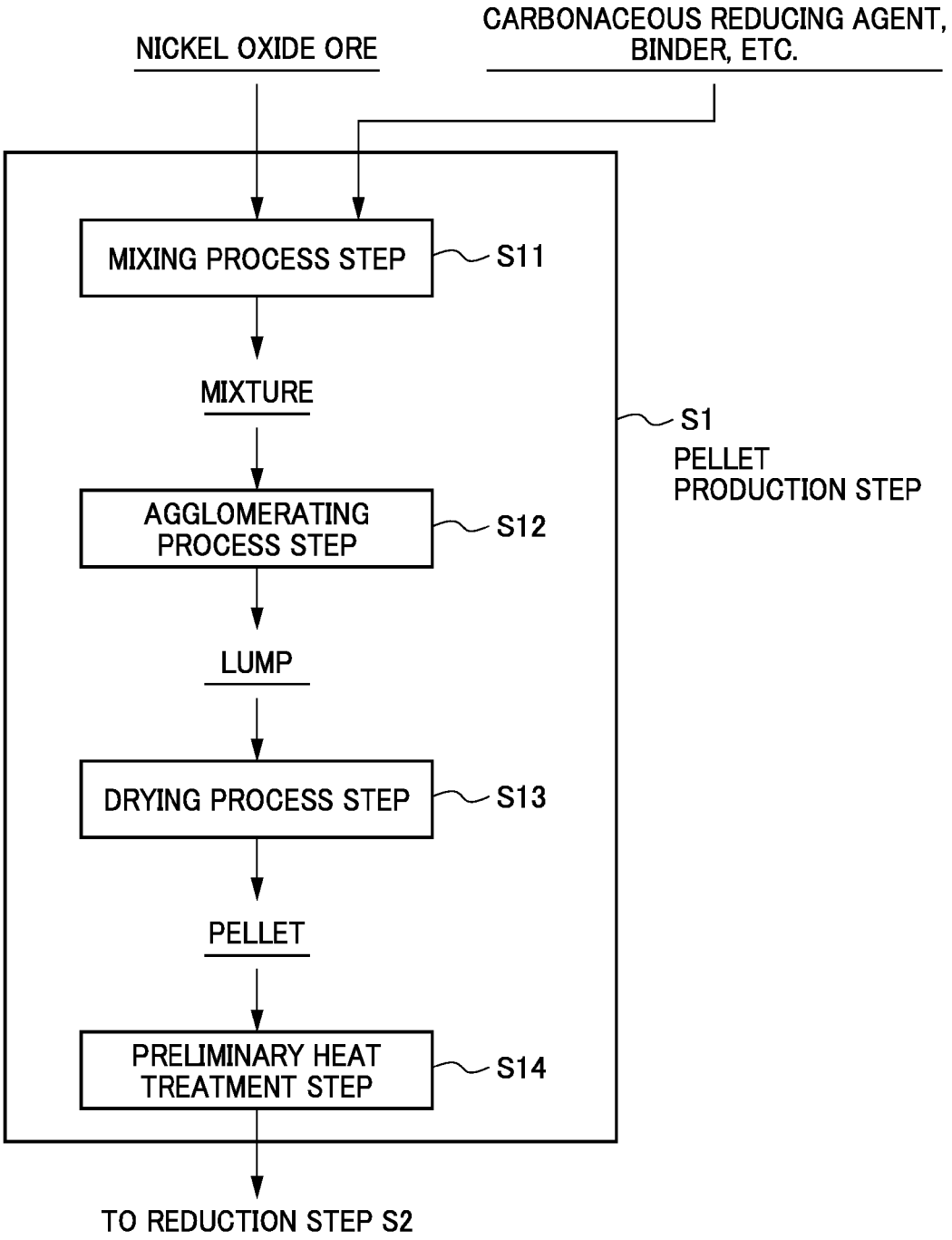
FIG. 2 is a process flow chart showing the flow of processing in a pellet production step of the method for smelting nickel oxide ore.

The pellet production step S1 produces pellets from nickel oxide ore, which is the raw material ore. FIG. 2 is a process flow chart showing the flow of processing in the pellet production step S1. As shown in FIG. 2, the pellet production step S1 includes a mixing process step S11 of mixing the raw materials including the nickel oxide ore, an agglomerating process step S12 of forming (granulating) the obtained mixture into a lump, and a drying process step S13 of drying the obtained lump.

(1) Mixing Process Step

The mixing process step S11 is a step of obtaining a mixture by mixing the raw material powders including nickel oxide ore. More specifically, this mixing process step S11 obtains a mixture by mixing raw material powders having a particle size on the order of 0.2 mm to 0.8 mm, for example, such as nickel oxide ore that is the raw material ore, iron ore, carbonaceous reducing agent, flux component and binder.

The nickel oxide ore is not particularly limited; however, it is possible to use limonite ore, saprolite ore, etc.

Although the iron ore is not particularly limited, for example, it is possible to use iron ore having iron quality of at least about 50%, hematite obtained from wet smelting of nickel oxide ore, etc.

In addition, powdered coal, pulverized coke, etc. are given as the carbonaceous reducing agent, for example. This carbonaceous reducing agent is preferably equivalent in particle size to the aforementioned nickel oxide ore. In addition, it is possible to give bentonite, polysaccharides, resins, water glass, dewatered cake, etc. as the binder, for example. In addition, it is possible to give calcium hydroxide, calcium carbonate, calcium oxide, silicon dioxide, etc. as the flux component, for example.

An example of the composition of a part of the raw material powders (wt %) is shown in Table 1 noted below. It should be noted that the composition of the raw material powders is not limited thereto.

TABLE 1

| Raw material powder [Wt %] | Ni | $Fe_2O_3$ | C |
|---|---|---|---|
| Nickel oxide ore | 1~2 | 10~60 | — |
| Iron ore | — | 80~95 | — |
| Carbonaceous reducing agent | — | — | ≈55 |

(2) Agglomerating Process Step

The agglomerating process step S12 is a step of forming (granulating) the mixture of raw material powders obtained in the mixing process step S11 into a lump. More specifically, it forms into pellet-shaped masses by adding the moisture required in agglomerating to the mixture obtained in the mixing process step S11, and using a lump production device (such as a rolling granulator, compression molding machine, extrusion machine), etc., or by the hands of a person.

The pellet shape is not particularly limited; however, it can be established as spherical, for example. In addition, although the size of the lump made into pellet shape is not particularly limited, passing through the drying process described later, for example, it is configured so as to become on the order of 10 mm to 30 mm in size (diameter in case of spherical pellet) of pellet to be charged into the reducing furnace, etc. in the reduction step S2.

(3) Drying Process Step

The drying process step S13 is a step of drying the lump obtained in the agglomerating process step S12. The lump made into a pellet-shaped mass by the agglomerating process becomes a sticky state in which moisture is included in excess at about 50 wt %, for example. In order to facilitate handling of this pellet-shaped lump, the drying process step S13 is configured to conduct the drying process so that the solid content of the lump becomes on the order of 70 wt % and the moisture becomes on the order of 30 wt %, for example.

More specifically, the drying process on the lump in the drying process step S13 is not particularly limited; however, it blows hot air at 300° C. to 400° C. onto the lump to make dry, for example. It should be noted that the temperature of the lump during this drying process is less than 100° C.

An example of the solid content composition (parts by weight) of the pellet-shaped lump after the drying process is shown in Table 2 noted below. It should be noted that the composition of the lump after the drying process is not limited thereto.

TABLE 2

| | Ni | $Fe_2O_3$ | $SiO_2$ | CaO | $Al_2O_3$ | MgO | Binder | other |
|---|---|---|---|---|---|---|---|---|
| Composition of pellet solid content after drying [Parts by weight] | 0.5~1.5 | 30~60 | 8~30 | 4~10 | 1~8 | 2~9 | 1 measure | remainder (including C: 5~17) |

The pellets obtained by conducting the drying process in this way are produced so that the size thereof is on the order of 10 mm to 30 mm, and have a strength that can maintain the shape, e.g., a strength for which the proportion of pellets breaking is no more than about 1% even in a case causing to drop from a height of 1 m, for example. Such pellets are able to endure shocks such as dropping upon charging into the subsequent process of the reduction step S2, and can maintain the shape of the pellets, and appropriate gaps are formed between pellets; therefore, the smelting reaction in the reduction step S2 will progress suitably.

Herein, as shown in the flowchart of FIG. 2, it may be configured so as to conduct preliminary heat treatment on the pellets formed by conducting the drying process on the lump containing nickel oxide ore in the drying process step S13 (preliminary heat treatment step S14).

Adhesive water contained in the nickel oxide ore constituting the lump, i.e. lump after the drying process (pellet), for example, contains solid content on the order of 70 wt % and moisture on the order of 30 wt %, and the sum total of the moisture added in order for efficient granulation and the adhesive water that had been contained in the original raw material powders can be sufficiently evaporatively removed by the preheat treatment in a reducing furnace in the reduction step S2 described later in detail. Incidentally, by removing moisture such as this adhesive water in advance preceding this preheat treatment, for example, it is possible to suppress a decline in the effect of preheat treatment accompanying the removal of adhesive water, like the preheat treatment itself becoming insufficient by the heating being insufficient. In other words, by performing preliminary heating on the formed pellet preceding the preheat treatment in the reduction step S2, it becomes possible to more effectively conduct preheat treatment in the reducing furnace, and it is possible to suppress breakage of pellets by effectively decreasing the crystallization water.

The temperature of preliminary heating in the preliminary heat treatment step S14 is not particularly limited, and it is possible to adjust as appropriate according to the size of the pellet, so long as being able to evaporatively remove the entire amount of adhesive water in the formed pellet. Thereamong, for example, if being a normal size for which the size of the pellet will be on the order of 10 mm to 30 mm, it is preferable to preliminarily heat this lump at a temperature of 100° C. to 170° C., and hold for over 2 hours or more.

If the preliminary heating temperature is less than 100° C., the hold time of preliminary heating will become long due to the evaporation rate of adhesive water being slow. On the other hand, if the preliminary heating temperature exceeds 170° C., an improvement in the effect of adhesive water removal will decrease. In addition, if the hold time of preliminary heating is less than 2 hours, there is a possibility of not being able to evaporate almost the entire amount of adhesive water. Therefore, by preliminarily heating the pellet of nickel oxide ore over 2 hours or more at a temperature of 100° C. to 170° C., it is possible to more effectively remove almost the entire amount of adhesive water contained.

It should be noted that, in regards to preliminary heating, since the removal of adhesive water contained in the nickel oxide ore is the object as mentioned above, the temperature may decline so long as being conditions for which the moisture does not increase after preliminary heating, upon charging into the reducing furnace in the subsequence process, which is the reduction step S2.

1.2. Reduction Step

The reduction step S2 reduces and heats the pellets obtained in the pellet production step S1 at a predetermined reduction temperature. By way of the reducing heat treatment of the pellets in this reduction step S2, the smelting reaction progresses, whereby metal and slag generate.

More specifically, the reducing heat treatment of the reduction step S2 is performed using a smelting furnace (reducing furnace), and reduces and heats the pellets containing nickel oxide ore by charging into the reducing furnace heated to a temperature on the order of 1400° C., for example.

Figure 3:
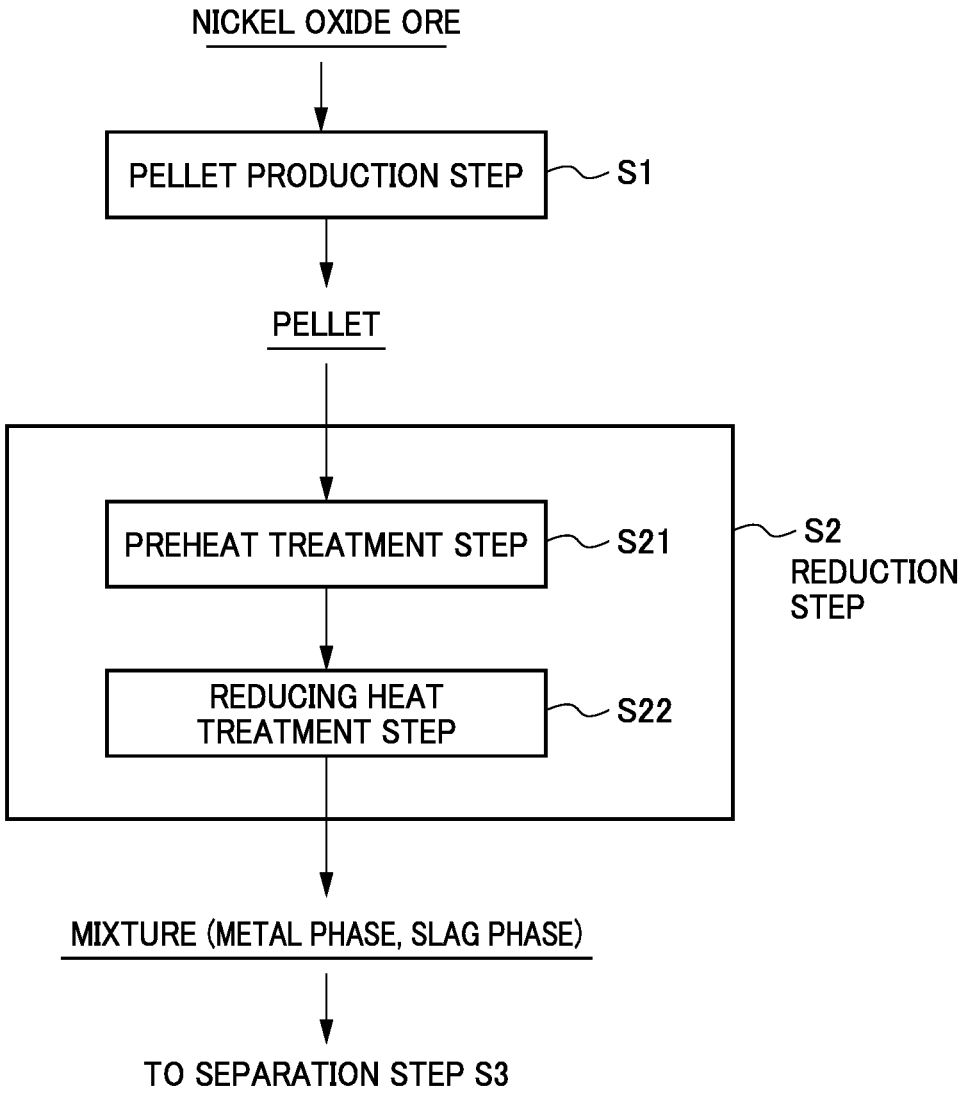
FIG. 3 is a process flow chart showing the flow of processing in a reduction step of the method for smelting nickel oxide ore.

Herein, a process flow chart showing the flow of processing in the reduction step S2 is shown in FIG. 3. As shown in FIG. 3, the reduction step S2 has a preheat treatment step S21 of charging the obtained pellets into a reducing furnace and preheat treating at a predetermined temperature, and a reducing heat treatment processing step S22 of reducing heat treating, at the reduction temperature, the pellets subjected to preheat treatment. In the present embodiment, it is characterized in that, after charging into the reducing furnace in this way, the pellets are preliminarily heated in this reducing furnace prior to reducing and heating at a predetermined reduction temperature. Although described later in detail, by conducting preheat treatment on pellets at a predetermined temperature prior to conducting the reducing heat treatment, it is possible to effectively suppress heat shock-induced cracking (breaking, crumbling) upon reducing and heating the pellets.

In the reducing heat treatment of this reduction step S2, the nickel oxide and iron oxide in the pellets near the surface of the pellet which tends to undergo the reduction reaction first are reduced to make an iron-nickel alloy (hereinafter iron-nickel alloy also referred to as "ferronickel") in a short time of about 1 minute, for example, and forms a husk (shell). On the other hand, the slag component in the pellet gradually melts accompanying the formation of the shell, whereby liquid-phase slag generates in the shell. In one pellet, the ferronickel metal (hereinafter referred to simply as "metal") and the ferronickel slag (hereinafter referred to simply as "slag") thereby generate separately.

Then, by extending the treatment time of the reducing heat treatment of the reduction step S2 up to on the order of 10 minutes further, the carbon component of the surplus carbonaceous reducing agent not contributing to the reduction reaction contained in the pellet is incorporated into the iron-nickel alloy and lowers the melting point. As a result thereof, the iron-nickel alloy melts to become liquid phase.

As mentioned above, although the slag in the pellet melts to become liquid phase, the metal and slag that have already generated separately become a mixture coexisting as the separate phases of the metal solid phase and slag solid phase by subsequent cooling, without blending together. The volume of this mixture shrinks to a volume on the order of 50% to 60% when comparing with the charged pellets.

In the case of the aforementioned smelting reaction progressing the most ideally, it will be obtained as one mixture made with the one metal solid phase and one slag solid phase coexisting relative to one loaded pellet, and becomes a solid in a "potbellied" shape. Herein, "potbellied" is a shape in which the metal solid phase and slag solid phase join. In the case of being a mixture having such a "potbellied" shape, since this mixture will be the largest as a particle size, the time and labor in recovery will lessen and it is possible to suppress a decline in metal recovery rate upon recovering from the reducing furnace.

It should be noted that the aforementioned surplus carbonaceous reducing agent is not only mixed into the pellets in the pellet production step S1 and, for example, it may be prepared by spreading over the coke, etc. on the hearth of the reducing furnace used in this reduction step S2.

In the method for smelting nickel oxide ore according to the present embodiment, as mentioned above, it is configured so as to preheat treat the obtained pellets at a predetermined temperature inside a reducing furnace prior to reducing and heating the pellets, and then the pellets on which preheat treatment was conducted in this way are reduced and heated. By conducting reducing heat treatment after preheat treating the pellets at a predetermined temperature, it is possible to decrease the occurrence of heat-shock received upon the reducing and heating, and it is possible to suppress the shape of this pellet from breaking down.

1.3. Separation Step

The separation step S3 recovers metal by separating the metal and slag generated in the reduction step S2. More specifically, the metal phase is separated and recovered from a mixture containing the metal phase (metal solid phase) and slag phase (slag solid phase containing carbonaceous reducing agent) obtained by the reducing heat treatment on the pellet.

As a method of separating the metal phase and slag phase from the mixture of the metal phase and slag phase obtained as solids, for example, it is possible to use a method of separating according to specific gravity, separating according to magnetism, cracking by a crusher, etc., in addition to a removal method of unwanted substances by sieving. In addition, it is possible to easily separate the obtained metal phase and slag phase due to having poor wettability, and relative to the aforementioned "potbellied" mixture, for example, it is possible to easily separate the metal phase and slag phase from this "potbellied" mixture by imparting shock such as providing a predetermined drop and allowing to fall, or imparting a predetermined vibration upon sieving.

The metal phase is recovered by separating the metal phase and slag phase in this way.

2. Preheat Treatment in Reduction Step

Next, preheat treatment in the reduction step S2 will be explained. As mentioned above, the reduction step S2 has a preheat treatment step S21 of charging the pellets obtained in the pellet production step S1 into a reducing furnace and preheat treating these pellets at a predetermined temperature, and a reducing heat treatment step S22 of reducing heat treating at the reduction temperature the pellets subjected to the preheat treatment (refer to the flowchart in FIG. 3). The present embodiment is characterized in that, upon reducing and heating the obtained pellets at a reduction temperature on the order of 1400° C., for example, with the reducing furnace, the pellets are preheat treated at a predetermined temperature with this reducing furnace prior to raising the reducing furnace to the reduction temperature (preheat treatment step S21).

In the preheat treatment on the pellets of nickel oxide ore in the preheat treatment step S21, the temperature thereof is important, and specifically, the pellets charged into the reducing furnace are preheat treated at a temperature of 350° C. to 600° C.

By conducing preheat treatment at a temperature of 350° C. to 600° C. on the pellets of nickel oxide ore charged into the reducing furnace, and subsequently raising the temperature of the reducing furnace to the reduction temperature and reducing and heating (reducing heat treatment step S22), it is possible to decrease the occurrence of heat shock received by the pellets due to the reducing and heating at high temperature, and thus possible to suppress the shape of this pellet from breaking down during this reducing heat treatment. More specifically, even in a case of conducting the reducing heat treatment on pellets by raising the reducing furnace to a high temperature of about 1400° C., it is possible to make the proportion of pellets breaking among all pellets a slight proportion at less than 10%, and it is possible to maintain the shape in at least 90% of the pellets.

Herein, as a mechanism by which the pellets of nickel oxide ore break down from heat-shock, it is by the temperature of the pellets suddenly rising by conducting the reducing heat treatment on the pellets at a high temperature on the order of about 1400° C., and the desorption of crystallization water contained in this nickel oxide ore occurring. In other words, when the temperature of the pellets suddenly rises, the breakage of pellets is considered to occur from the crystallization water vaporizing and expanding to form steam, and passing inside the pellet instantly. It should be noted that crystallization water is not water molecules adhering to particles, but refers to moisture characteristic to nickel oxide ore which is trapped as a crystalline structure.

In this point, by configuring so as to conduct preheat treatment at a temperature of 350° C. to 600° C. on the pellets of nickel oxide ore with the reducing furnace prior to reducing and heating at a high temperature on the order of about 1400° C., it is possible to decrease the crystallization water contained in the nickel oxide ore constituting the pellets. Given this, even in a case of suddenly raising the reducing furnace to a temperature of at about 1400° C. after this preheat treatment, it is possible to suppress breakage of pellets from the aforementioned desorption of crystallization water. In addition, by conducting preheat treatment on the pellets at a temperature of 350° C. to 600° C., and subsequently raising the temperature of the reducing furnace to make the pellets reach the reduction temperature, the thermal expansion of particles such as the nickel oxide ore, carbonaceous reducing agent, binder and flux component constituting the pellets, becomes two stages and will advance slowly, whereby it is possible to suppress the breakage of pellets caused by the expansion difference between particles.

As the preheating temperature for the pellet, it is set to the range of 350° C. to 600° C., as mentioned above. By preheat treating the pellet containing nickel oxide ore at a temperature of 350° C. to 600° C., it is possible to configure so as to effectively decrease the crystallization water, and allow thermal expansion to progress slowly, and thus possible to make the frequency of pellet breakage a negligible value at less than 10%. If the temperature of the preheat treatment is less than 350° C., the separation of crystallization water contained in the nickel oxide ore will be insufficient, and it will not be possible to effectively suppress breakage of pellets due to the desorption of crystallization water. On the other hand, if the temperature of preheat treatment exceeds 600° C., sudden thermal expansion of particles will be induced by this preheat treatment, and similarly, it will no longer be possible to effectively suppress breakage of pellets.

Furthermore, as the preheat temperature, it is more preferable to set in the range of 400° C. to 550° C. By preheat treating the pellet containing nickel oxide ore at 400° C. or higher, the effect of mitigating sudden thermal expansion of particles will further rise, and by setting the preheat treatment temperature to no higher than 550° C., it is possible to avoid unnecessary heating for the separation of crystallization water, and thus possible to efficiency treat. In this way, it is possible to substantially prevent breakage of pellets by preheat treating the pellets containing nickel oxide ore at 400° C. to 550° C.

As mentioned above, there are causes of two pathways to pellet breakage by the temperature of pellets suddenly rising from room temperature to the reduction temperature on the order of 1400° C., one being sudden desorption of crystallization water contained in the nickel oxide ore constituting the pellets, and the other one being the sudden thermal expansion of particles constituting the pellets.

In order to suppress the sudden desorption of crystallization water, more specifically, it is important to heat to a temperature of 350° C. to 550° C. It is thereby possible to slowly cause crystallization water to desorb in advance, prior to the pellets rising to the reduction temperature, and thus prevent breakage of pellets caused by sudden desorption of crystallization water.

In addition, in order to suppress the sudden expansion of particles constituting the pellets, more specifically, it is important to preheat to a temperature of 400° C. to 600° C. It is thereby possible to preheat at a temperature from 400° C., which is the minimum temperature tolerable for sudden temperature rise after preheating (rise to reduction temperature), up to 600° C., which is the maximum temperature tolerable for sudden temperature rise as the preheating temperature itself, the expansion of particles can be slowed, and thus it is possible to prevent the breakage of pellets caused by thermal expansion.

Therefore, it is most preferable to preheat treat with the preheating temperature of 400° C. to 550° C., which is the temperature range making it possible to more effectively suppress the breakage of pellets based on the aforementioned causes of two pathways.

As the processing time of the preheat treatment, although it is not particularly limited and may be adjusted as appropriate according to the size of the pellet containing nickel oxide ore, it is possible to set to a processing time on the order of 10 minutes to 60 minutes, if a pellet of normal size for which the size thereof will be on the order of 10 mm to 30 mm.

Now, in the method for smelting nickel oxide ore, it is important to configure so as to raise the reducing furnace promptly to the reduction temperature of 1400° C., for example, while in a state retaining the pellets subjected to the preheat treatment at a temperature of 350° C. to 600° C. in the preheat treatment step S21 at this preheat treatment temperature in this way, and then perform the reducing heat treatment with this reducing furnace (reducing heat treatment step S22).

As mentioned above, as one of the causes of pellet breakage, there is sudden thermal expansion of the particles constituting the pellets, and if allowing the temperature of pellets after the preheat treatment to decline from the preheat treatment temperature, a sudden temperature rise will occur again in the pellet at the stage of performing reducing heat treatment, and sudden thermal expansion will occur. Given this, even in a case of performing preheat treatment on pellets, the breakage of pellets will occur from this sudden thermal expansion, and there is a possibility of no longer being able to maintain the shape. Therefore, from the viewpoint of the occurrence of such thermal expansion, it is preferable to configure so as to successively conduct the reducing heat treatment with the reducing furnace without allowing the pellets after the preheat treatment to decline from this preheat treatment temperature.

As explained in detail above, the present embodiment is characterized in that, after charging the obtained pellets into the reducing furnace in the reduction step S2, the pellets are preheat treated at a temperature of 350° C. to 600° C. with this reducing furnace prior to raising the reducing furnace to the reduction temperature. According to such a method, it is possible to suppress the pellets from breaking during the reducing heat treatment at high temperature performed successively, and thus possible to make the smelting reaction to occur much more effectively.

Herein, pellets on which the preheat treatment was conducted with the reducing furnace, for example, come to be pellets in which the $H_2O$ component was eliminated by the preheat treatment from the chemical composition $FeO(OH).nH_2O$, which is the main component of limonite and saprolite, and specifically, are pellets containing limonite or saprolite with FeO(OH) as the main component. More specifically, pellets of nickel oxide ore are obtained from the aforementioned preheat treatment in the reducing furnace with FeO(OH) as the main component, and Ni quality of 0.5% to 1.5%, $H_2O$ quality of no more than 0.1%, and C quality of 10% to 30% by weight ratio. It should be noted that these pellets may contain Ca, Si, etc. originating from the flux component.

EXAMPLES

Hereinafter, the present invention will be explained more specifically by showing Examples and Comparative Examples; however, the present invention is not to be limited to the following Examples.

Example 1

Nickel oxide ore serving as raw material ore, iron ore, coal which is a carbonaceous reducing agent, silica sand and limestone which are flux components, and binder were mixed to obtain a mixture. Next, a lump was formed by adding the appropriate moisture to the mixture of raw material powders obtained, and kneading by hand. Then, a drying process was conducted by blowing hot air at 300° C. to 400° C. onto the lump so that the solid content of the obtained lump became about 70 wt %, and the moisture about 30 wt % to produce the pellet. The solid content composition of the pellet after the drying process is shown in Table 3 noted below. It should be noted that carbon was contained in the proportion of 23 parts by weight in the obtained pellets.

TABLE 3

| | Ni | $Fe_2O_3$ | $SiO_2$ | CaO | $Al_2O_3$ | MgO | Binder | other |
|---|---|---|---|---|---|---|---|---|
| Composition of pellet solid content after drying [Parts by weight] | 0.7 | 52.5 | 14.8 | 5.5 | 3.3 | 6.0 | 1 | remainder (including C: 13) |

Next, one hundred of the obtained pellets were charged into the reducing furnace and preheat treatment was performed on these pellets. More specifically, preheat treatment holding the pellets at 350° C. for 30 minutes was performed. Subsequently, reducing heat treatment was performed by raising the reducing furnace up to 1400° C., which is the reduction temperature, while maintaining the obtained pellets at a temperature of 350° C. It should be noted that the $H_2O$ quality contained in the pellets after the preheat treatment was 0.1%.

The state after 3 minutes (time in a range for which melting of the metal shell does not progress, and the form of pellets is maintained) since the start of the reducing heat treatment was observed, the number of broken pellets was counted, and the percentage was calculated as the proportion of pellets that broke (number broken/number charged).

As a result thereof, the proportion of broken pellets was slight at 8% in Example 1.

Example 2

Except for performing preheat treatment that held the pellets charged into the reducing furnace at 600° C. for 30 minutes, the pellets were reduced and heated similarly to Example 1. It should be noted that the $H_2O$ quality contained in the pellets after the preheat treatment was less than 0.01%.

As a result thereof, the proportion of broken pellets was slight at 2% in Example 2.

Example 3

Except for performing preheat treatment that held the pellets charged into the reducing furnace at 400° C. for 30 minutes, the pellets were reduced and heated similarly to Example 1. It should be noted that the $H_2O$ quality contained in the pellets after the preheat treatment was 0.07%.

As a result thereof, the proportion of broken pellets in Example 3 was 0%, and thus entirely unbroken.

Example 4

Except for performing preheat treatment that held the pellets charged into the reducing furnace at 450° C. for 30 minutes, the pellets were reduced and heated similarly to Example 1. It should be noted that the $H_2O$ quality contained in the pellets after the preheat treatment was 0.05%.

As a result thereof, the proportion of broken pellets in Example 4 was 0%, and thus entirely unbroken.

Example 5

Except for performing preheat treatment that held the pellets charged into the reducing furnace at 550° C. for 30 minutes, the pellets were reduced and heated similarly to Example 1. It should be noted that the $H_2O$ quality contained in the pellets after the preheat treatment was 0.03%.

As a result thereof, the proportion of broken pellets in Example 5 was 0%, and thus entirely unbroken.

Comparative Example 1

Except for performing preheat treatment that held the pellets charged into the reducing furnace at 300° C. for 30 minutes, the pellets were reduced and heated similarly to Example 1. It should be noted that the $H_2O$ quality contained in the pellets after the preheat treatment was 1%.

As a result thereof, the proportion of broken pellets in Comparative Example 1 became 50%, and thus the commercial smelting operation of nickel oxide ore was difficult.

Comparative Example 2

Except for performing preheat treatment that held the pellets charged into the reducing furnace at 650° C. for 30 minutes, the pellets were reduced and heated similarly to Example 1. It should be noted that the $H_2O$ quality contained in the pellets after the preheat treatment was less than 0.01%.

As a result thereof, the proportion of broken pellets in Comparative Example 2 became 55%, and thus the commercial smelting operation of nickel oxide ore was difficult.

The invention claimed is:

1. A method for smelting nickel oxide ore using pellets of nickel oxide ore, the method comprising:

a pellet production step of producing pellets from the nickel oxide ore; and a reduction step of conducting a reducing process that heats the pellets obtained at a predetermined reduction temperature with a reducing furnace, wherein the pellets are produced in the pellet production step by conducting heat treatment on a lump made by forming the nickel oxide ore into an aggregate form by holding at a temperature of 100° C. to 170° C. for 2 hours or more in an apparatus different from the reducing furnace, and the size of the pellets produced from the nickel oxide ore in the pellet production step is on the order of 10 mm to 30 mm in size, and wherein the pellets obtained in the pellet production step are charged into the reducing furnace, and the pellets are heated in the reducing furnace to 400° C. to 550° C. before reduction begins.

* * * * *